US009318806B2

(12) United States Patent
Yarga et al.

(10) Patent No.: US 9,318,806 B2
(45) Date of Patent: Apr. 19, 2016

(54) ELECTRONIC DEVICE WITH BALANCED-FED SATELLITE COMMUNICATIONS ANTENNAS

(71) Applicant: Apple Inc., Cupertino, CA (US)

(72) Inventors: Salih Yarga, Sunnyvale, CA (US); Miroslav Samardzija, Mountain View, CA (US); Enrique Ayala Vazquez, Watsonville, CA (US); Harish Rajagopalan, San Jose, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 183 days.

(21) Appl. No.: 14/058,024

(22) Filed: Oct. 18, 2013

(65) Prior Publication Data

US 2015/0109167 A1 Apr. 23, 2015

(51) Int. Cl.

| | |
|---|---|
| ***H01Q 1/38*** | (2006.01) |
| ***H01Q 9/16*** | (2006.01) |
| ***H01Q 5/328*** | (2015.01) |
| ***H01Q 1/24*** | (2006.01) |
| ***H01Q 5/371*** | (2015.01) |

(52) U.S. Cl.

CPC ..... *H01Q 5/328* (2015.01); *H01Q 1/243* (2013.01); *H01Q 5/371* (2015.01)

(58) Field of Classification Search

USPC ..... 343/700 MS, 793, 795, 821

See application file for complete search history.

(56) References Cited

U.S. PATENT DOCUMENTS

| | | | | |
|---|---|---|---|---|
| 5,532,708 | A * | 7/1996 | Krenz et al. | 343/795 |
| 6,018,324 | A | 1/2000 | Kitchener | |
| 7,239,290 | B2 | 7/2007 | Poilasne et al. | |
| 7,733,285 | B2 | 6/2010 | Gainey et al. | |
| 2004/0252070 | A1 * | 12/2004 | Chuang | 343/795 |
| 2005/0237260 | A1 * | 10/2005 | Bancroft | 343/859 |
| 2008/0238800 | A1 | 10/2008 | Collins | |
| 2009/0207092 | A1 * | 8/2009 | Nysen et al. | 343/876 |
| 2014/0132469 | A1 * | 5/2014 | Wang et al. | 343/821 |

FOREIGN PATENT DOCUMENTS

| | | |
|---|---|---|
| EP | 2 230 723 | 9/2010 |

* cited by examiner

*Primary Examiner* — Tan Ho

(74) *Attorney, Agent, or Firm* — Treyz Law Group, P.C.; G. Victor Treyz; Michael H. Lyons

(57) ABSTRACT

An electronic device may include balance-fed antenna structures that do not have direct paths to ground. The antenna structures may serve as a Global Positioning System (GPS) antenna and may have a dipole structure having a first and second antenna resonating element arms. The antenna structures may include a conductive path that conveys antenna signals between a first feed terminal on the first antenna resonating element arm and a transmission line. The conductive path may overlap with the second antenna resonating element arm such that current flow through the conductive path induces corresponding current flow in the second antenna resonating element arm. The antenna structures may include an impedance matching short-circuit stub path that couples the first antenna resonating element arm to the second antenna resonating element arm. Choke inductors may be used to help block indirect paths from the antenna structures to ground through adjacent circuitry.

19 Claims, 12 Drawing Sheets

ELECTRONIC DEVICE WITH BALANCED-FED SATELLITE COMMUNICATIONS ANTENNAS

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antennas with desired attributes. In some wireless devices, an antenna is used for satellite communications such as Global Positioning System communications. The antenna is often formed with an unbalanced-fed arrangement having a shorting path to a ground plane. For example, an inverted-F antenna has a resonating element that is directly coupled to the ground plane by a shorting path. However, unbalanced-fed antennas having such shorting paths may produce undesirable antenna radiation characteristics. In particular, the shorting paths allow the formation of substantial antenna ground plane currents that can undesirably alter the radiation patterns of the antenna.

It would therefore be desirable to be able to provide improved antenna structures for electronic devices that are used for satellite communications.

SUMMARY

An electronic device may include balanced-fed antenna structures (sometimes referred to herein as balance-fed antenna structures). Balance-fed antenna structures do not have direct paths to ground and therefore are not electrically connected to any ground structures. The balance-fed antenna structures may serve as a Global Positioning System (GPS) antenna and may have a dipole structure having a first and second antenna resonating element arms. An unbalanced transmission line such as a coaxial cable may be coupled to the balance-fed dipole antenna structures and coupled to ground structures. The antenna structures may include a conductive path that conveys antenna signals between a first feed terminal on the first antenna resonating element arm and the unbalanced transmission line. The conductive path may overlap with the second antenna resonating element arm such that current flow through the conductive path induces corresponding current flow in the second antenna resonating element arm (and vice versa). The induced current flow in the second antenna resonating element arm serves to indirectly feed a second antenna feed terminal on the second antenna resonating element arm. The antenna structures may include a short-circuit stub path that couples the first antenna resonating element arm to the second antenna resonating element arm and is configured to match the impedance of the antenna structures to the transmission line.

The antenna structures may be formed on a carrier structure such as a flexible circuit substrate, housing of adjacent circuitry, plastic support structures, or other carrier structures on which the antenna resonating element arms may be formed. For example, the first and second antenna resonating element arms may be formed as first patterned metal layer on a flexible circuit substrate, whereas the conductive path may be formed as a second patterned metal layer that is coupled to the first patterned metal layer by a via that extends through the flexible circuit substrate. As another example, the antenna resonating element arms may be plated onto a plastic carrier.

Circuitry such as microphone circuitry, camera circuitry, or other circuitry may be adjacent to the antenna structures. The adjacent circuitry may be coupled to the ground structures via conductive paths. Choke inductors may be interposed in the conductive paths between the adjacent circuitry and the ground structures and serve to help block indirect paths from the antenna structures to ground while accommodating normal operations of the adjacent circuitry. The choke inductors block radio-frequency antenna signals while passing signals at lower frequencies associated with the adjacent circuitry.

DETAILED DESCRIPTION

Electronic devices may be provided with antenna structures for satellite communications such as Global Positioning System (GPS) communications and the Global Navigation Satellite System (GLONASS). Satellite antenna structures may have an upper-hemisphere orientation that helps improve reception from GPS satellites located in the upper hemisphere. The GPS antenna structures may have a balance-fed architecture such that antenna currents are focused in antenna resonating elements and ground plane currents are reduced.

Figure 1:
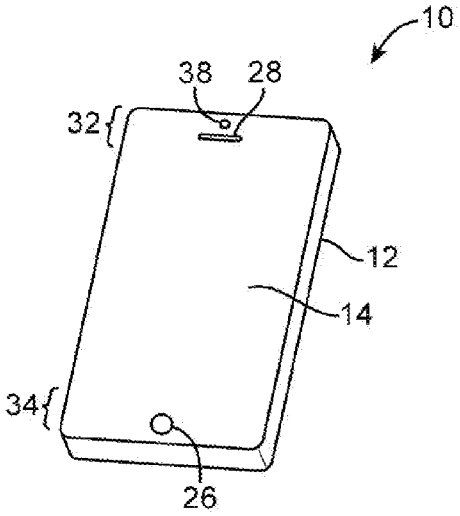
FIG. 1 is a perspective view of an illustrative electronic device such as a handheld electronic device with wireless circuitry in accordance with an embodiment.
Figure 2:
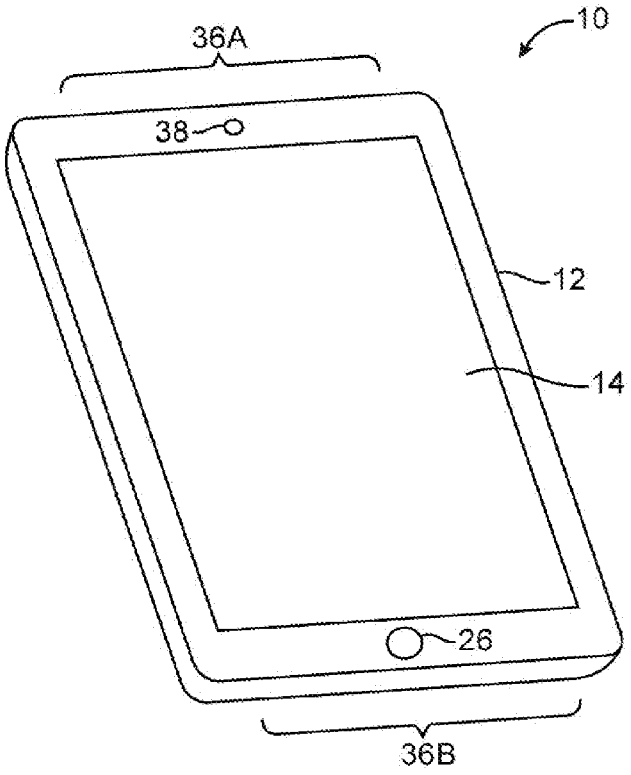
FIG. 2 is a perspective view of an illustrative electronic device such as a tablet computer with wireless circuitry in accordance with an embodiment.

Illustrative electronic devices that have antenna structures with balance-fed architectures are shown in FIGS. 1 and 2.

FIG. 1 shows an illustrative configuration for electronic device 10 based on a handheld device such as a cellular telephone, music player, gaming device, navigation unit, or other compact device. In this type of configuration for device 10, housing 12 has opposing front and rear surfaces. Display 14 is mounted on a front face of housing 12. Display 14 may have an exterior layer that includes openings for components such as button 26, speaker port 28, and camera 38. Antennas in device 10 of FIG. 1 may be located at locations in housing 12 such as upper end 32 and lower end 34.

Figure 3:
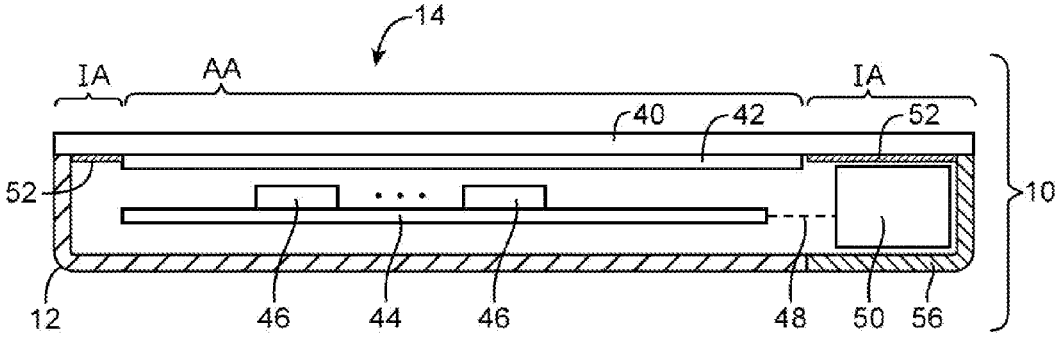
FIG. 3 is a cross-sectional side view of an electronic device with wireless circuitry in accordance with an embodiment.

In the example of FIG. 2, electronic device 10 is a tablet computer. In electronic device 10 of FIG. 3, housing 12 has opposing front and rear surfaces. Display 14 is mounted on the front surface of housing 12. As shown in FIG. 3, display 14 has an external layer with an opening to accommodate button 26. Antennas may be located in regions such as one or more regions 36 (e.g., 36A or 36B) along the edge of housing 12 and display 14.

Antennas may be provided in other electronic devices if desired. In general, device 10 may be computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. The illustrative configurations for device 10 that are shown in FIGS. 1 and 2 are merely illustrative.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 of device 10 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

A cross-sectional side view of an illustrative electronic device of the type that may be provided with antenna structures is shown in FIG. 3. As shown in FIG. 3, display 14 in device 10 may have display cover layer 40 and display module 42. Display layers in display module 42 may include display pixels formed from liquid crystal display (LCD) components or other suitable display pixel structures such as organic light-emitting diode display pixels, electrophoretic display pixels, plasma display pixels, etc. The display pixels may be arranged in an array having numerous rows and columns to form a rectangular active area AA that is surrounded by an inactive border region such as inactive area IA. When viewed from the front of display 14, inactive area IA may have the shape of a rectangular ring.

Display cover layer 40 may cover the surface of display 14 or a display layer such as a color filter layer (e.g., a layer formed from a clear substrate covered with patterned color filter elements) or other portion of a display may be used as the outermost (or nearly outermost) layer in display 14. The outermost display layer may be formed from a transparent glass sheet, a clear plastic layer, or other transparent member. To hide internal components from view, the underside of the outermost display layer or other display layer surface in inactive area IA may be coated with opaque masking layer 52 (e.g., a layer of opaque ink such as a layer of black ink).

Antenna structures 50 may be mounted under inactive area IA. Antenna structures 50 may include one or more antennas for device 10. Antenna structures 50 may include antennas with resonating elements that are formed from loop antenna structures, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. The example of FIG. 3 in which antenna structures 50 are mounted under inactive area IA is merely illustrative. If desired, one or more antenna structures 50 may be mounted in any desired regions of device 10 (e.g., regions 32 or 34 of FIG. 1, regions 36A or 36B of FIG. 2, etc.).

Opaque masking layer 52 and display cover layer 40 may be radio-transparent, so that radio-frequency antenna signals can be transmitted and received through display cover layer 40 in inactive area IA and opaque masking layer 52. Housing 12 may be formed from a dielectric such as plastic that is transparent to radio-frequency signals or may be formed from a material such as metal in which an antenna window such as antenna window 56 has been formed. Antenna window 56 may be formed from a dielectric such as plastic, so that antenna window 56 is transparent to radio-frequency signals. During operation, antenna signals associated with antenna structures 50 may pass through the portions of display 14 in inactive area IA that overlap antenna structures 50 and/or through antenna window 56 and/or other dielectric portions of housing 12.

Device 10 may contain electrical components 46. Components 46 may be mounted on one or more substrates such as printed circuit 44. Printed circuit 44 may be a rigid printed circuit board (e.g., a printed circuit formed from a rigid printed circuit board material such as fiberglass-filled epoxy) or a flexible printed circuit (e.g., a flex circuit formed from a sheet of polyimide or other layer of flexible polymer). Electrical components 46 may include integrated circuits, connectors, sensors, light-emitting components, audio components, discrete devices such as inductors, capacitors, and resistors, switches, and other electrical devices. Paths such as path 48 may be used to couple antenna structures 50 to wireless circuitry on substrates such as printed circuit 44. Paths such as path 48 may include transmission line paths such as stripline transmission lines, microstrip transmission lines, coplanar transmission lines, coaxial cable transmission lines, transmission lines formed on flexible printed circuits, transmission lines formed on rigid printed circuit boards, or other signal paths.

Figure 4:
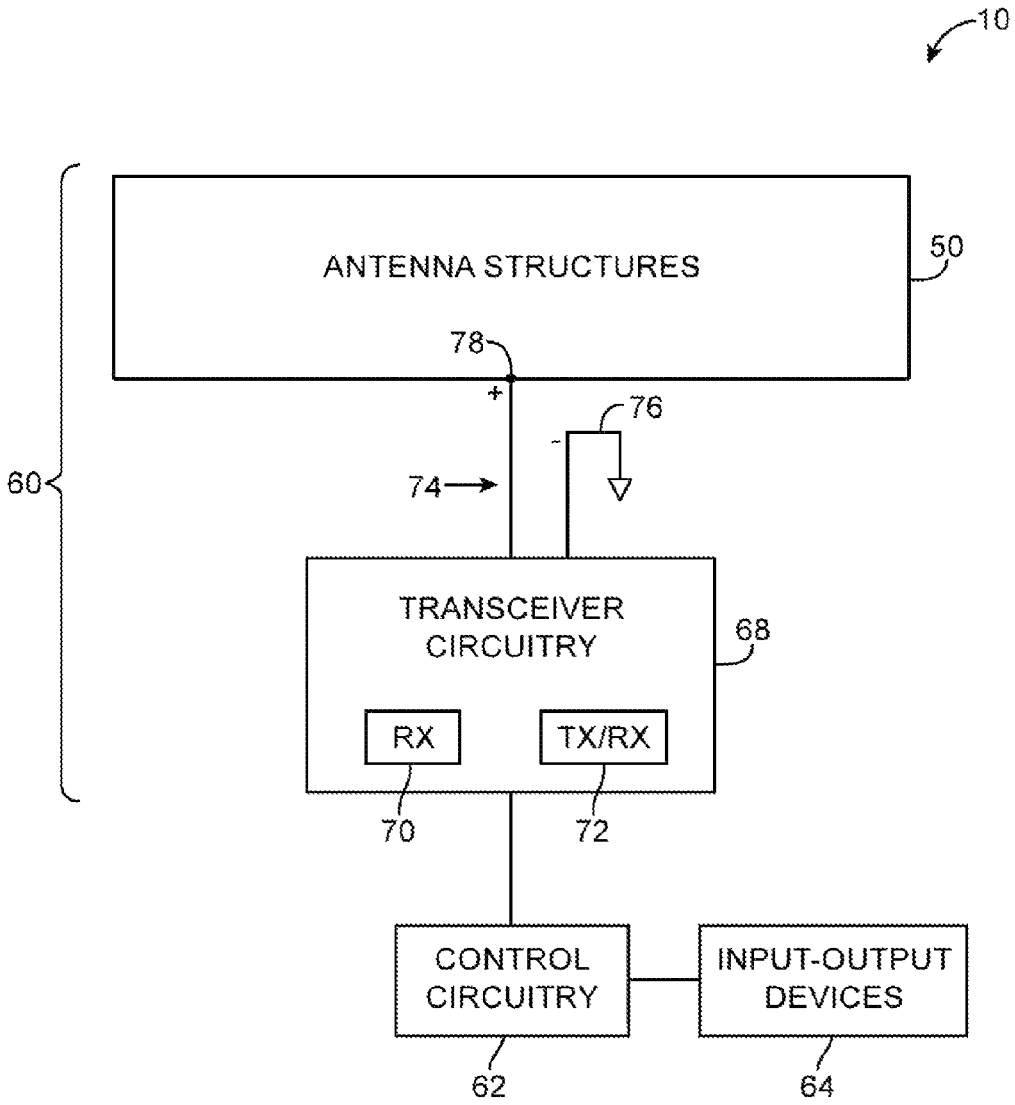
FIG. 4 is a schematic diagram of an illustrative electronic device with wireless circuitry in accordance with an embodiment.

FIG. 4 is a diagram showing how antenna structures 50 may have a balance-fed arrangement. As shown in FIG. 4, electronic device 10 may include wireless circuitry 60. Wireless circuitry 60 may include antenna structures 50, radiofrequency transceiver circuitry 68, and, if desired, other circuitry such as front-end circuitry (e.g., matching circuitry, etc.).

Antenna structures 50 may include one or more antennas. Antenna structures 50 may be used for transmitting and receiving wireless signals (as an example). Transceiver circuitry 68 may include transmitters and receivers for transmitting and receiving antenna signals through antenna structures 50. For example, transceiver circuitry 68 may have a transmitter-receiver 72 for transmitting and receiving antenna signals and a receiver such as receiver 70 for receiving antenna signals such as cellular communications signals. Receiver 70 may, as an example, be configured to receive signals at GPS frequencies and/or GLONASS frequencies. Examples of GPS frequencies include 1575 MHz and 1227 MHz, whereas GLONASS frequencies may include 1602 MHz. Transmission line 74 may be used to route signals between transceiver circuitry 68 (e.g., receiver 70) and antenna structures 50. Transmission line 74 may be an unbalanced transmission line such as a coaxial cable. For example, positive antenna feed signals may be conveyed between receiver 70 and antenna structures 50, whereas ground antenna feed signals may be conveyed between receiver 70 and a ground terminal 76. The ground terminal may be a point on ground structures such as the device housing, a ground plane, or other conductive ground structures. Antenna structures 50 has a balanced-fed configuration in which antenna structures 50 are not electrically connected (i.e., directly coupled by a conductive path) to ground. Balanced signals from the antenna structures may be converted to unbalanced signals for the transmission line using feed structures on antenna structures 50 or using a balun such as a chip balun.

The antennas in device 10 may be used to support any communications bands of interest. For example, device 10 may include antenna structures for supporting GPS communications or other satellite navigation system communications, local area network communications, voice and data cellular telephone communications, Bluetooth® communications, etc.

As shown in FIG. 4, electronic device 10 may include control circuitry 62. Control circuitry 62 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 62 may be used to control the operation of device 10. The processing circuitry may be based on one or more microprocessors, microcontrollers, digital signal processors, baseband processors, power management units, audio codec chips, application specific integrated circuits, etc.

Control circuitry 62 may be used to run software on device 10, such as satellite navigation applications, internet browsing applications, voice-over-internet-protocol (VOIP) telephone call applications, email applications, media playback applications, operating system functions, etc. To support interactions with external equipment, control circuitry 62 may be used in implementing communications protocols. Communications protocols that may be implemented using the storage and processing circuitry of control circuitry 62 include satellite navigation communications protocols, internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Input-output circuitry in device 10 such as input-output devices 64 may be used to allow data to be supplied to device 10 and to allow data to be provided from device 10 to external devices. Input-output devices 64 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 64 and may receive status information and other output from device 10 using the output resources of input-output devices 64.

Figure 5:
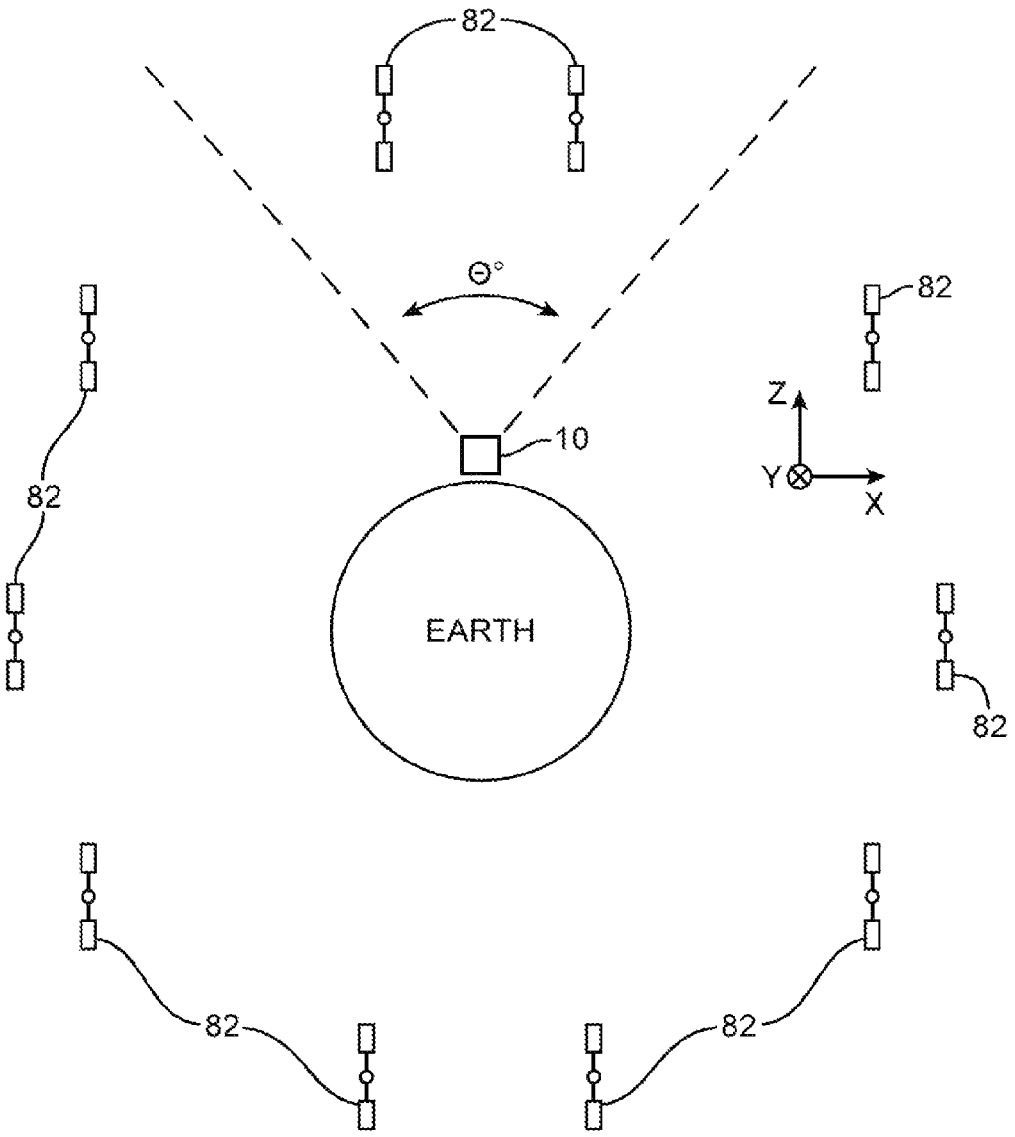
FIG. 5 is a diagram showing how an electronic device may communicate with satellites in accordance with an embodiment.

FIG. 5 is an illustrative diagram showing how satellite communications performance may be dependent on radiation patterns of an electronic device. As shown in FIG. 5, satellites 82 may be located in space around the Earth. Electronic device 10 that is located at the surface of the Earth may communicate with one or more satellites 82 that are located above device 10. In other words, device 10 communicates with satellites located in the upper hemisphere. It may therefore be desirable to improve antenna sensitivity in the direction of satellites 82 that are located in the upper hemisphere (i.e., above device 10). Antenna performance for satellite communications performance is sometimes characterized by the sensitivity within a 0° window above device 10. θ may, for example, be 120°.

Electronic devices such as device 10 may be operated in various orientations such as portrait or landscape. During satellite navigation operations, device 10 of FIG. 2 may often be operated in a portrait mode in which antenna structures 36A are directed towards the upper hemisphere satellites (along the Z axis) and antenna structures 36B are closer to the Earth. It may therefore be desirable to configure an antenna in region 36A and its radiation patterns for satellite navigation communications with upper hemisphere satellites.

Figure 6:
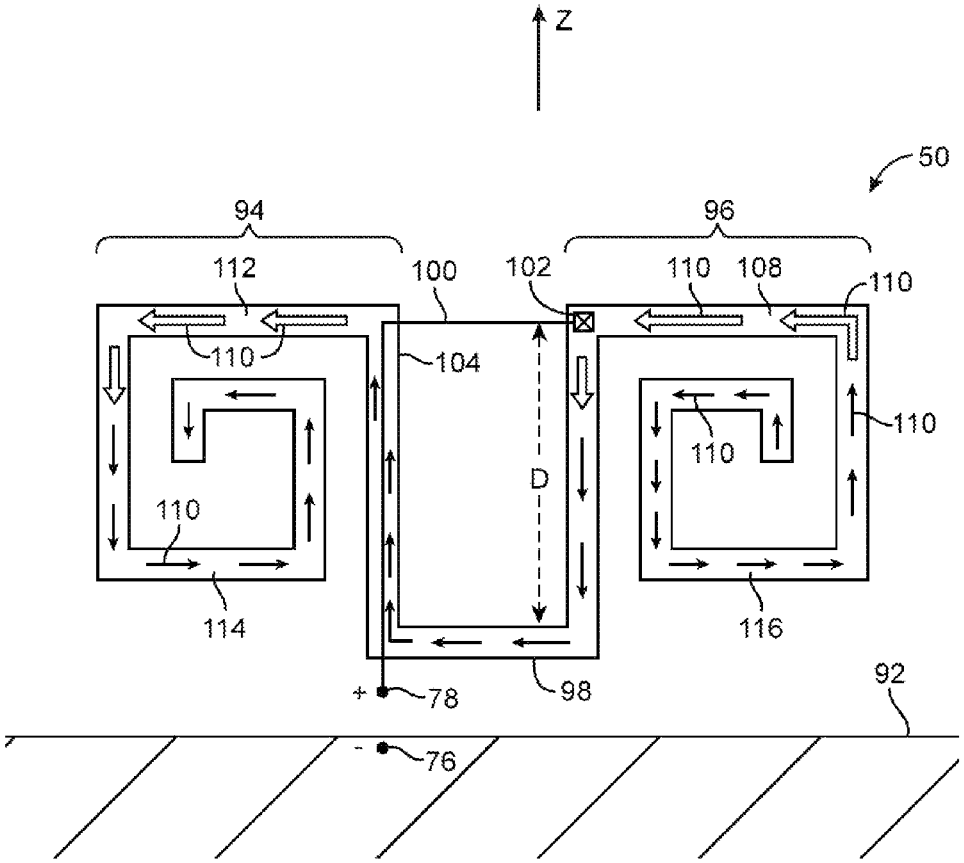
FIG. 6 is an illustrative diagram of a balance-fed dipole antenna in accordance with an embodiment.

FIG. 6 is a diagram of illustrative antenna structures 50 that may provide improved satellite navigation communications. Antenna structures 50 have a balance-fed arrangement in which antenna structures 50 are not electrically connected by a conductive path to any ground structures such as structures 92. As shown in FIG. 6, antenna structures 50 may be coupled to an unbalanced transmission line at terminal 78. The unbalanced transmission line may be grounded to ground plane 92. For example, an outer conductor of a coaxial cable may be coupled to ground plane 92, whereas the inner signal conductor may be coupled to terminal 78.

Antenna structures 50 may include resonating element arms 94 and 96 that form a dipole structure. In the example of FIG. 6, resonating element arms 94 and 96 are configured in a meandering structure including multiple 90° bends, which helps to conserve space by reducing antenna area. In general, resonating element arms 94 and 96 may include bends of any desired degree (e.g., 45°, 90°, 180°, etc.) and may include zero or more bends.

Antenna structures 50 may be fed using a conductive path 100 that is coupled to terminal 78 and antenna resonating element arm 96. Path 100 may be connected to antenna resonating element arm 96 via connection 102. Conductive path 100 may be separated from antenna resonating element arms 94 and 96 by an intervening insulating layer such as a dielectric layer. Path 100 may provide positive antenna feed signals from feed terminal 78 to antenna resonating element arm 96. Path 100 may overlap with segment 104 of antenna resonating element arm 94 so that currents flowing in path 100 generate an electric field that induces corresponding currents in segment 104 (e.g., due to near-field coupling). Similarly, currents flowing in segment 104 generate an electric field that induces corresponding currents in path 100. In other words, the currents flowing through antenna resonating arm 94 are aligned with path 100 and are also therefore aligned with the currents flowing through antenna resonating arm 96. Connection 102 and segment 104 effectively serve as respective first and second antenna feed terminals for antenna structures 50. Segment 104 is indirectly fed via path 100, whereas connection 102 is directly fed by path 100.

Antenna resonating structures 50 may include conductive path 98 that electrically couples arms 94 and 96 and serves as a short-circuit stub path for impedance matching with a transmission line. Conductive path 98 includes a short-circuit portion located at a distance D away from connection 102, which may be adjusted to match the impedance of antenna resonating structures 50 to the impedance of the transmission line coupled to feed terminal 78 at desired operating frequencies. For example, distance D may be selected based on the wavelength of a desired operating frequency for impedance matching.

Antenna feed path 100 may be connected to portion 108 of antenna resonating element arm 96 that is typically oriented towards the upper hemisphere (e.g., that is closer than other portions of arm 96 to satellites 82 in a portrait orientation of device 10 of FIG. 5). As indicated by thicker arrows, antenna currents 110 are concentrated in portion 108 that is coupled to antenna feed path 100 and in mirror portion 112 of antenna resonating element arm 94. In contrast, less current flows through portions such as portions 114 and 116 of the antenna resonating element arms. Portions 108 and 112 are located farther away from ground structures 92 than other portions such as portions 114 and 116, which helps reduce any near-field coupling between antenna structures 50 and ground plane 92 and therefore helps to reduce ground plane currents. Consequently, antenna currents are substantially concentrated within antenna structures 50 and the radiation pattern of antenna structures 50 may be focused in direction Z (e.g., towards satellites in the upper hemisphere).

Figure 7:
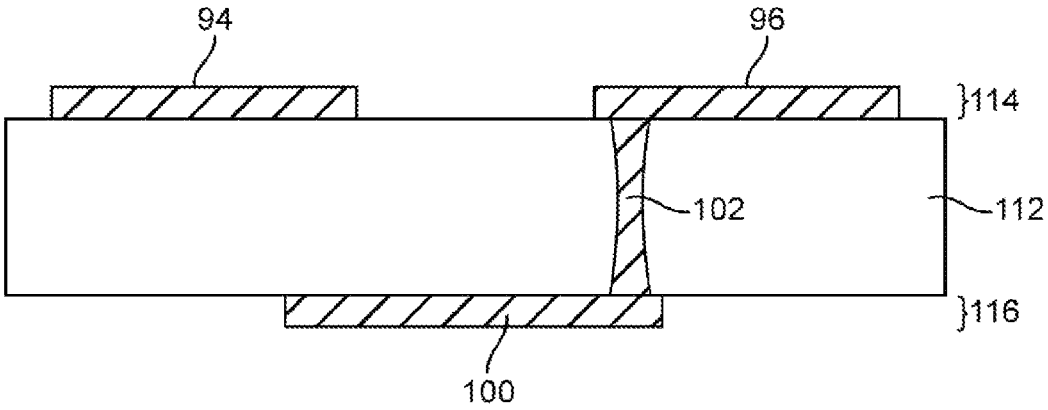
FIG. 7 is cross-sectional side view of an illustrative balance-fed dipole antenna formed on a substrate in accordance with an embodiment.

Antenna structures 50 may be formed as patterned layers on a substrate. FIG. 7 is an illustrative cross-sectional side view of antenna structures 50 on substrate 112. Substrate 112 may be a rigid or flexible printed circuit board on which multiple patterned metal layers are formed. In the example of FIG. 7, patterned metal layers 114 and 116 are formed on opposing front and rear surfaces of substrate 112. Metal layer 114 may be patterned to form antenna resonating element arms 94 and 96, whereas metal layer 116 may be patterned to form conductive path 100 that partially overlaps with resonating element arms 94 and 96. Conductive path 100 of metal layer 116 may be electrically coupled to conductive path 96 of metal layer 114 by conductive via 102 that extends through substrate 112.

Figure 8:
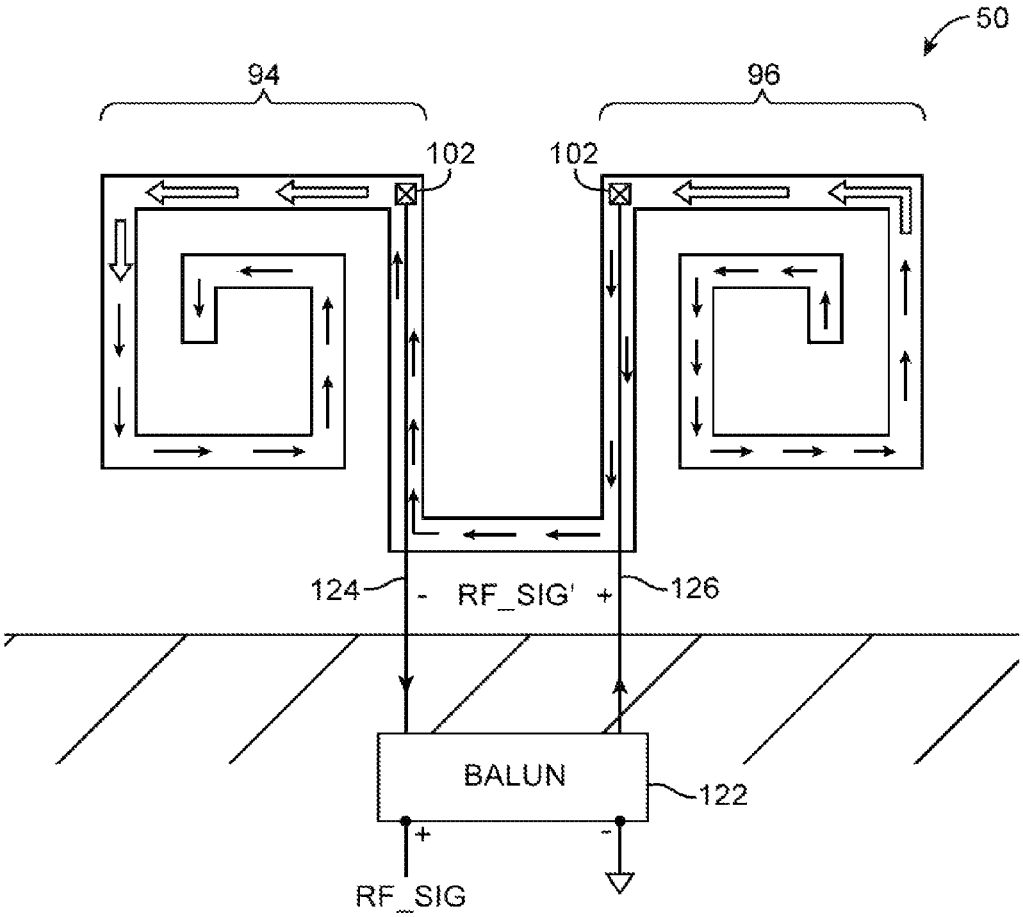
FIG. 8 is an illustrative diagram of a balance-fed dipole antenna that is coupled to a balun in accordance with an embodiment.

The example of FIG. 6 in which an unbalanced transmission line is adapted to feed balanced-fed antenna structures 50 is merely illustrative. If desired, balanced-fed antenna structures 50 may be fed using any desired balanced feeding arrangement. FIG. 8 is an illustrative diagram of balanced-fed antenna structures 50 that is fed with antenna signals using balun 122 that adapts an unbalanced transmission line for balanced feeding. Balun 122 may receive or produce antenna feed signal RF_SIG at a positive input terminal and may be grounded at a ground input terminal. Balun 122 may convert balanced antenna signals RF_SIG' that are received from resonating arms 94 and 96 of antenna structures 50 via connections 102 to unbalanced signal RF_SIG (and vice versa). Balun 122 may be implemented using circuitry on an integrated circuit (sometimes referred to as a chip balun). Chip balun 122 may provide improved bandwidth, whereas the feeding arrangement of FIG. 6 may provide reduced cost.

Figure 9:
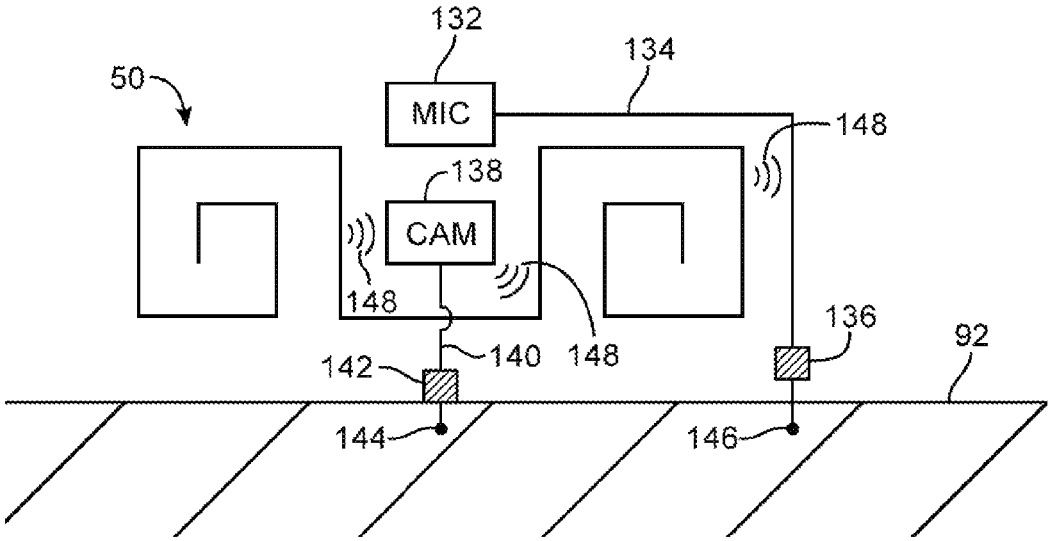
FIG. 9 is an illustrative diagram showing how choke inductors may be provided for circuitry adjacent to a balance-fed antenna to block indirect grounding paths in accordance with an embodiment.

Antenna structures 50 may be used in compact electronic devices such as portable electronic devices in which space is limited. In such scenarios, antenna structures 50 may be located adjacent to or within close proximity of nearby circuitry. FIG. 9 is an illustrative diagram of a scenario in which antenna structures 50 are located adjacent to camera circuitry 138 and microphone circuitry 132. Ground plane 92 may serve as an electrical ground for camera circuitry 138 and microphone circuitry 132. Camera circuitry 138 may be coupled to ground plane 92 via path 140, whereas microphone circuitry 132 may be coupled to ground plane 92 via path 134. For example, camera circuitry 138 may be formed on a flexible circuit substrate and path 140 may be patterned metal on the flexible circuitry substrate that is connected to ground plane 92 or other ground structures. Similarly, microphone circuitry 132 or other adjacent circuitry may be formed on a flexible circuit substrate.

During wireless communications, radio-frequency signals received by antenna structures 50 can potentially couple to adjacent circuitry such as camera circuitry 138, path 140, microphone 132, and path 134. For example, electric fields produced by antenna currents can cause near-field coupling to camera circuitry 138, path 140, microphone circuitry 132, and path 134. Current that is induced in paths 134 and 140 by antenna currents may travel to ground plane 92 and cause ground plane 92 to resonate and produce wireless signals. Wireless emissions from ground plane 92 may be typically oriented away from the upper hemisphere during satellite navigation communications (e.g., when the electronic device is operated in a portrait mode). Ground plane emissions may therefore alter the radiation patterns of antenna structures 50, as substantial power may be radiated by ground plane 92 instead of antenna structures 50. Consequently, the antenna performance for satellite communications (e.g., 120° upper hemisphere performance) may be reduced.

Circuitry that is proximate or adjacent to antenna structures 50 may be provided with choke inductors that help to isolate ground structures from antenna currents. The choke inductors serve as high-frequency open circuits and low-frequency short circuits. In the example of FIG. 9, choke inductor 136 is coupled in series between path 134 and ground plane 92. Choke inductor 136 blocks radio-frequency signals at frequencies associated with antenna structures 50 while passing low-frequency or direct-current (DC) signals associated with microphone circuitry 132. Choke inductor 136 may therefore be sometimes referred to as a radio-frequency choke. As an example, microphone circuitry 132 may produce signals within an audible frequency range of 20 Hz to 20 kHz. In this scenario, choke inductor 136 may pass signals within the audible frequency range while blocking radio-frequency signals such as those used for GPS communications (e.g., at 1575 MHz, at 1227 MHz, etc.). In this way, choke inductor 136 may help block indirect grounding paths for antenna structures 50 without interfering with normal operation of microphone 132. Choke inductor 136 may have an inductance between 220 nH and 520 nH (as an example).

Choke inductor 142 may be coupled between camera 138 and ground plane 92 to block radio-frequency antenna signals without interfering with camera operations (e.g., camera operations using direct-current or signals at frequencies lower than satellite communications frequencies). In general, choke inductors may be used to block indirect antenna current paths to ground, which helps to reduce ground plane currents and maintain the upper-hemisphere orientation of antenna structures 50.

Figure 10:
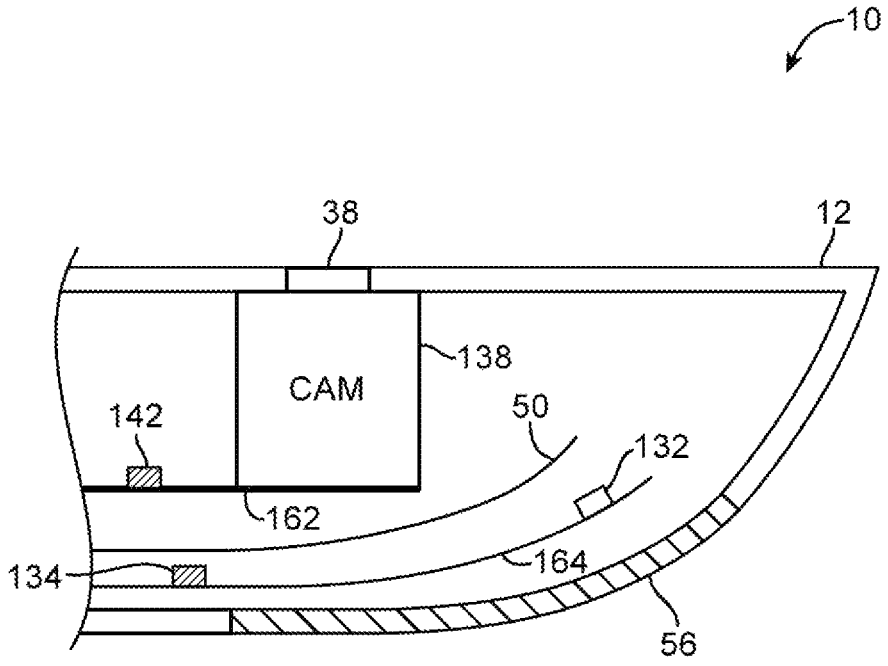
FIG. 10 is a cross-sectional side view of an illustrative electronic device having balance-fed antenna structures and adjacent circuitry in accordance with an embodiment.

FIG. 10 is an illustrative cross-sectional view of a device 10 including antenna structures 50 and adjacent circuitry. In the example of FIG. 10, antenna structures 50 are formed on a flexible circuit substrate (e.g., as patterned layers on the flexible circuit substrate such as shown in FIG. 7). Camera circuitry 138 and choke inductor 142 may be mounted on flexible circuit substrate 162. Camera circuitry 138 may capture images from incident light received through camera lens 38. Conductive paths such as path 140 of FIG. 9 may be formed as a patterned metal layer on substrate 162. Similarly, microphone 132 and choke inductor 134 may be mounted to flexible circuit substrate 164. Antenna window 56 may pass radio-frequency signals to and/or from antenna structures 50 in scenarios in which housing 12 is formed of conductive materials. If desired, antenna window 56 may be omitted in scenarios such as when housing 12 passes radio-frequency signals (e.g., housing 12 is formed from plastic).

Figure 11:
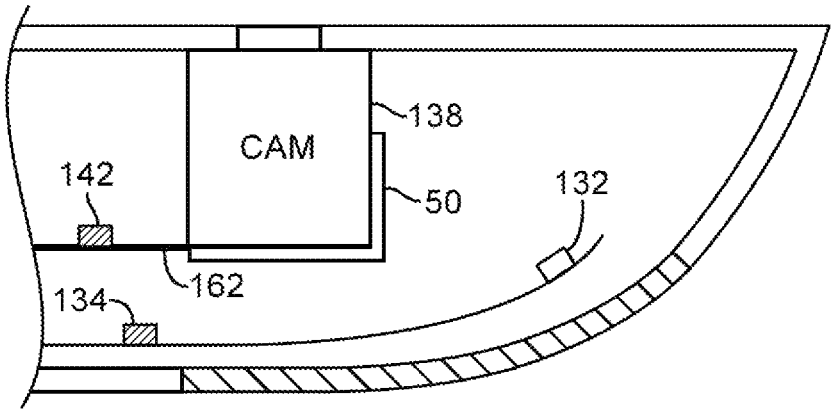
FIG. 11 is a cross-sectional side view of an illustrative electronic device having balance-fed antenna structures formed on the housing of adjacent circuitry in accordance with an embodiment.

The example of FIG. 10 in which antenna structures 50 are formed with patterned metal layers on a flexible substrate is merely illustrative. If desired, antenna structures may be formed from patterned metal layers on any desired carrier structure. FIG. 11 is an illustrative diagram showing how antenna structures 50 may be formed on camera circuitry 138. As shown in FIG. 11, antenna structures 50 may be formed as a patterned metal layer on exterior surfaces of camera module 138. Antenna structures 50 may be formed on one or more surfaces of camera module 138 using laser direct structuring (LDS) tools. For example, camera circuitry 138 may have a plastic housing. A laser may be used to etch the pattern of antenna structures 50 on the exterior surfaces of the plastic housing, which activates the etched regions. Subsequently, the plastic housing may be plated with a metal such as copper (e.g., via electroless plating) such that the copper is only plated on the activated regions of the camera housing to form antenna structures 50. Choke inductors such as inductors 142 and 134 may be provided for adjacent circuitry such as camera circuitry 138 and microphone circuitry 132.

Figure 12:
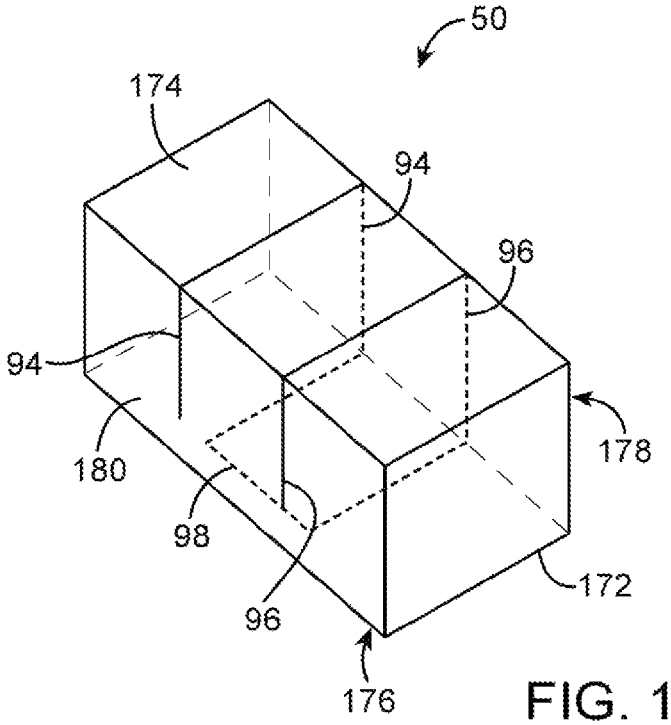
FIG. 12 is a perspective view of antenna structures formed in a first configuration on a carrier in accordance with an embodiment.
Figure 13:
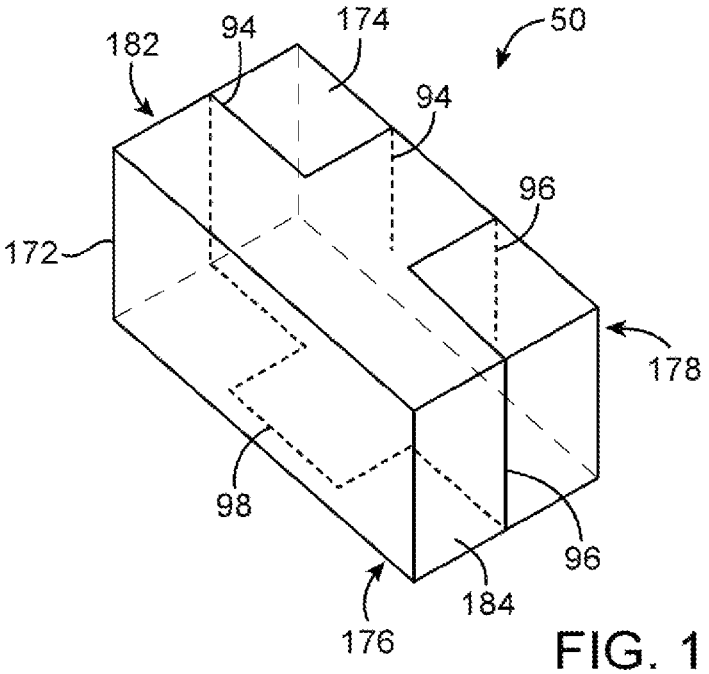
FIG. 13 is a perspective view of antenna structures formed in a second configuration on a carrier in accordance with an embodiment.

Antenna structures on a carrier structure may have various configurations. FIGS. 12 and 13 are perspective views of illustrative antenna structure configurations on carrier structures 172. In the example of FIG. 12, antenna structures 50 has a balance-fed dipole structure similar to antenna structures 50 of FIG. 6. Antenna structures 50 may be formed from an antenna resonating element having arms 94 and 96 that are electrically coupled by short-circuit stub path 98. As shown in FIG. 12, antenna structures 50 may be formed on multiple exterior surfaces of carrier structures 172 (e.g., on opposing top surface 174 and bottom surface 176, and two opposing side surfaces 178 and 180). If desired, arms 94 and 96 may have meandering patterns including one or more bends on any given surface of carrier structure 172. In the example of FIG. 13, antenna resonating element arm 94 may be formed on bottom surface 176, top surface 174, and side surfaces 182 and 178, whereas antenna resonating element arm 96 may be formed on bottom surface 176, top surface 174, and side surfaces 184 and 178. These examples are merely illustrative. Antenna structures 50 may be formed on any desired number of surfaces of a carrier structure and may include zero or more bends on each surface. The antenna structures may be formed by plating metal on the carrier structure using LDS tools.

Figure 14:
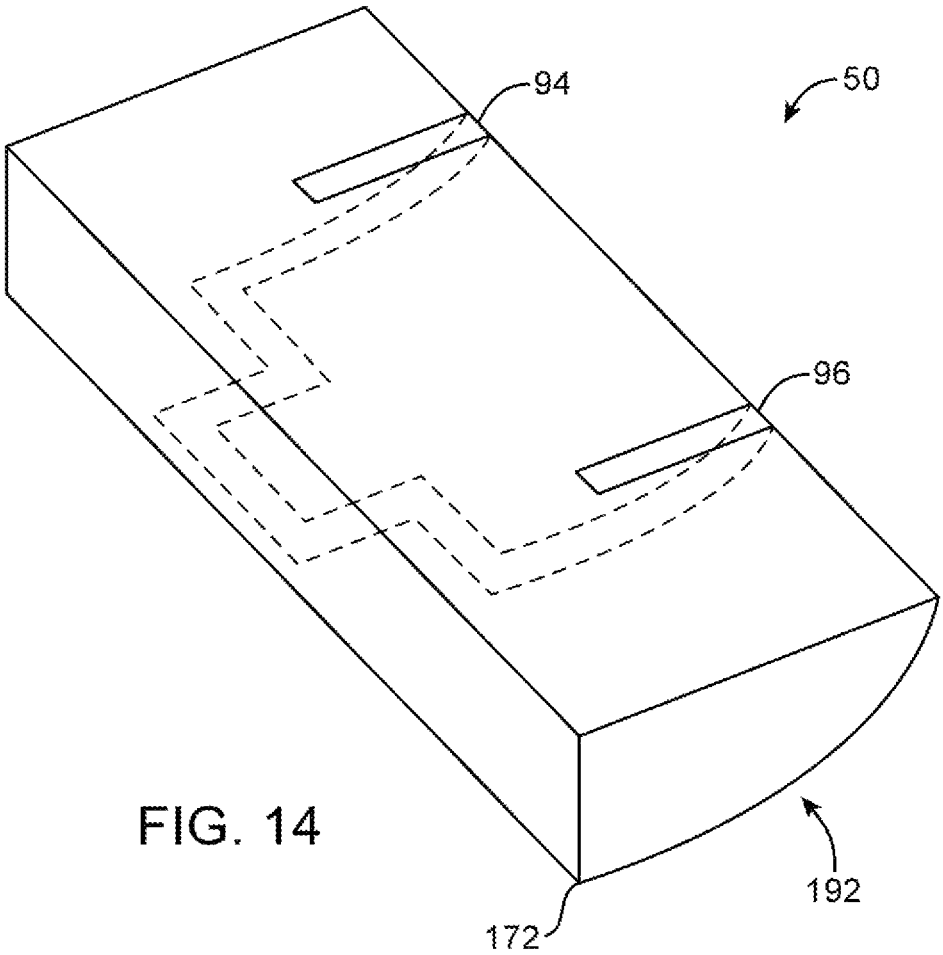
FIG. 14 is a perspective view of antenna structures formed on a carrier having a curved surface in accordance with an embodiment.

If desired, carrier structures may include one or more curved surfaces on which antenna structures may be formed. FIG. 14 is an illustrative perspective view of carrier structures 172 having a curved surface 192. Non-linear surfaces such as curved surface 192 may help to accommodate constrained or irregular space within a device housing. For example, curved surface 192 may mate with a curved surface of device housing 12 of FIG. 10 to more efficiently utilize the available space within housing 12. Antenna resonating element arms 94 and 96 may be formed on curved surface 192 and other surfaces of carrier structure 172.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

ground structures;

balance-fed dipole antenna structures that are not electrically connected to any of the ground structures and that receive satellite communications signals, wherein the balance-fed dipole antenna structures comprise a conductive path and a first antenna resonating element arm that comprises a plurality of antenna resonating element arm portions, the conductive path being connected to a given antenna resonating element arm portion that is located at a distance from the ground structures that is greater than each other antenna resonating element arm portion of the plurality of antenna resonating element arm portions; and radio-frequency receiver circuitry that processes the received satellite communications signals.

2. The electronic device defined in claim 1 wherein the balance-fed dipole antenna structures form a Global Positioning System antenna.

3. The electronic device defined in claim 2 further comprising:

an unbalanced transmission line that is coupled to the balance-fed dipole antenna structures and is coupled to the ground structures.

4. The electronic device defined in claim 3 wherein the conductive path conveys antenna signals between the unbalanced transmission line and the first antenna resonating element arm, the balance-fed dipole antenna structures further comprising:

a second antenna resonating element arm that overlaps with the conductive path, wherein current flow through the conductive path induces corresponding current flow in the second antenna resonating element arm.

5. The electronic device defined in claim 4 wherein the balance-fed dipole antenna structures further comprise:

a stub path that couples the first antenna resonating element arm to the second antenna resonating element arm and is configured to match the impedance of the balance-fed dipole antenna structures to the unbalanced transmission line.

6. The electronic device defined in claim 5 wherein the first antenna resonating element arm has a meandering structure with at least two bends.

7. The electronic device defined in claim 5 further comprising:

a carrier structure on which the balance-fed dipole antenna structures are formed.

8. The electronic device defined in claim 7 wherein the carrier structure comprises a flexible circuit substrate, the first and second antenna resonating element arms are formed in a first patterned metal layer on the flexible circuit substrate, and the conductive path is formed in a second patterned metal layer on the flexible circuit substrate.

9. The electronic device defined in claim 8 further comprising:

a via extending through the flexible circuit substrate that electrically connects the conductive path to the first antenna resonating element.

10. The electronic device defined in claim 7 wherein the carrier structure comprises a plastic carrier structure and wherein the first and second antenna resonating element arms are plated onto the plastic carrier structure.

11. The electronic device defined in claim 10 wherein the carrier structure comprises a camera housing, the electronic device further comprising:

a flexible circuit substrate on which the camera housing is mounted;

an additional conductive path on the flexible circuit substrate that couples the camera housing to the ground structures; and a choke inductor in the additional conductive path.

12. The electronic device defined in claim 2 further comprising:

ground structures; and a chip balun having a first terminal coupled to the first antenna resonating element, a second terminal coupled to the second antenna resonating element, a third terminal coupled to the ground structures, and a fourth terminal, wherein the chip balun converts balanced radio-frequency receive signals at the first and second terminals to unbalanced radio-frequency receive signals at the fourth terminal.

13. Antenna structures, comprising:

a first antenna resonating element arm;

a second antenna resonating element arm;

a first conductive path that is coupled to a first feed terminal on the first antenna resonating element arm and overlaps the second antenna resonating element arm, wherein a second feed terminal on the second antenna resonating element arm is indirectly fed by the conductive path;

a camera housing;

a flexible circuit substrate on which the camera housing is mounted; and a second conductive path on the flexible circuit substrate that is coupled to the camera housing.

14. The antenna structures defined in claim 13 further comprising:

a stub path that couples the first antenna resonating element arm to the second antenna resonating element arm and impedance matches the antenna structures to a transmission line.

15. The antenna structures defined in claim 14 further comprising:

an additional flexible circuit substrate having opposing front and rear surfaces, wherein the first and second antenna resonating element arms are formed on the front surface, the first conductive path is formed on the rear surface, and the first conductive path is coupled to the first feed terminal on the first antenna resonating element arm by a via that extends through the flexible circuit substrate.

16. The antenna structures defined in claim 14 further comprising:

a plastic carrier, wherein the first and second resonating element arms are formed on multiple surfaces of the plastic carrier.

17. An electronic device, comprising:

a balance-fed radio-frequency antenna;

ground structures;

circuitry that is coupled to the ground structures and adjacent to the balance-fed radio-frequency antenna; and at least one choke inductor that is coupled between the circuitry and the ground structures.

18. The electronic device defined in claim 17 wherein the balance-fed radiofrequency antenna comprises a Global Positioning System antenna that is not electrically connected to the ground structures.

19. The electronic device defined in claim 18 wherein the circuitry comprises microphone circuitry and wherein the balance-fed radio-frequency antenna comprises:

a first antenna resonating element arm;

a second antenna resonating element arm; and a conductive path that is coupled to a feed point on the first antenna resonating element arm and overlaps with the second antenna resonating element arm, wherein an electric field between the conductive path and the second antenna resonating element arm aligns current in the conductive path to current in the second antenna resonating element during antenna operations.

* * * * *